United States Patent [19]

Burger et al.

[11] Patent Number: 4,558,642

[45] Date of Patent: Dec. 17, 1985

[54] DAMPER FOR A ROTARY PRINTING MACHINE

[75] Inventors: Rainer Burger; Rudolf Annecke, both of Augsburg, Fed. Rep. of Germany

[73] Assignee: M.A.N.-Roland Druckmaschinen Aktiengesellschaft, Offenbach am Main, Fed. Rep. of Germany

[21] Appl. No.: 654,868

[22] Filed: Sep. 27, 1984

[30] Foreign Application Priority Data

Oct. 11, 1983 [DE] Fed. Rep. of Germany ..... 3336875

[51] Int. Cl.[4] ..... B41F 7/26; B41F 7/30

[52] U.S. Cl. ..... 101/148

[58] Field of Search ..... 101/147, 148, 366

[56] References Cited

U.S. PATENT DOCUMENTS

| | | | |
|---|---|---|---|
| 2,689,522 | 9/1954 | Curtis | 101/148 X |
| 3,146,706 | 9/1964 | Tonkin et al. | 101/148 |
| 3,508,489 | 4/1970 | Norton | 101/148 |
| 3,890,898 | 6/1975 | Fischer | 101/148 |
| 3,924,531 | 12/1975 | Klingler | 101/147 |
| 4,188,882 | 2/1980 | Jeschke et al. | 101/148 |

FOREIGN PATENT DOCUMENTS

| | | |
|---|---|---|
| 439999 | 12/1976 | Fed. Rep. of Germany . |
| 609911 | 3/1979 | Switzerland . |

*Primary Examiner*—Edgar S. Burr

*Assistant Examiner*—Charles A. Pearson

*Attorney, Agent, or Firm*—Frishauf, Holtz, Goodman & Woodward

[57] ABSTRACT

To improve the uniformity of application of damping liquid, typically water, to a plate cylinder (8) of an offset rotary printing machine, a non-contacting, typically spray damper (18) sprays or otherwise applies damping liquid on a damping liquid accepting cylinder (19) with a hard, preferably chrome-plated surface. The damping liquid is applied to the plate cylinder by an application cylinder or roller (21) having a soft, for example rubber or textile surface. A transfer cylinder (20) transfers the water between the accepting roller (19) and the application roller (21). In accordance with the invention, the transfer roller (20) has a soft, for example rubber surface. The soft or rubber surface apparently causes formation of an ink-damping liquid emulsion on the surface thereof which is extremely fine grain to provide a highly uniform coating of damping liquid to the application roller (21). To improve the fineness of damping liquid distribution, more than one (201, 202) such transfer cylinders may be used, each having a soft, typically rubbery surface. Without such soft, rubbery surface transfer cylinders, the minimum number of rollers, for example three (19, 20, 21) would not be possible while still providing a uniform film of damping liquid to the plate cylinder.

9 Claims, 2 Drawing Figures

DAMPER FOR A ROTARY PRINTING MACHINE

Reference to related patents:

German Pat. No. 24 39 999 German Pat. No. 22 58 321, to which U.S. Pat. No. 3,924,531, Klingler, corresponds Swiss Pat. No. 609,911.

The present invention relates to a damper to apply damping liquid, typically water, to the printing plate of a rotary printing machine, typically an offset printing machine, by spraying or slinging damping liquid on a roller having a hard surface receptive to the damping liquid, from which drops or tiny droplets are transferred to a damping application roller via a transfer roller.

BACKGROUND

The simplest form of a contactless damper, such as a slinger or spray apparatus, is described in the referenced German Pat. No. 24 39 999. The disclosure of this patent describes a spray device by means of which damping liquid in form of drops or droplets is applied to a first roller having a hard surface. The surface is preferably metallic. It is also possible to apply damping liquids to such a surface by means of brushes, see for example Swiss Pat. No. 609,911. The damping liquid then is homogenized, for example by means of a rubbing roller, and applied by an application roller having a soft surface on the printing plate of a cylinder which is to have the damping liquid applied.

It has also been proposed—see U.S. Pat. No. 3,924,531, to which German Pat. No. 22 58 321 corresponds—to include an additional rubbing roller between the first roller receiving the damping liquid, that is, on which the damping liquid is sprayed or applied by brushes, and the actual damping liquid application roller applying the damping liquid on the plate of the plate cylinder. In accordance with the usual convention known and used in the inker and damper technology, this additional roller has a hard, usually metallic surface. Such a rubbing cylinder is, as known, driven by a positive drive; the actual damping application roller is carried along by friction. The intermediate rubbing or distribution or homogenizing cylinder usually is chrome-plated, that is, has a layer thereon which is hydrophilic, or otherwise, is receptive to damping liquid. The damping liquid application roller always must be soft, or elastic, at least at its surface, and for that reason it is usually supplied with an outside coating or jacket of rubber or plastic.

All roller coatings, known and customarily used in printing machinery, which apply damping liquid to the plate cylinder also, however, accept ink. The ink on the damping liquid application roller prevents formation of a closed and uniform layer of damping liquid, for example of water, since the liquid will adhere to this, usually undesirable, ink layer in form of drops or droplets, or will be worked into this ink layer in such form. This is particularly disadvantageous in the printing machines in which subsequent damping is used, that is, in which water or other damping liquid is applied to the printing plate to be damped after inking thereof. In this case, the ink application roller will not have a smoothing effect, and a non-uniform application of water will be directly visible on the printed subject matter. It is frequently possible to observe, on the printed copy, the formation of drops.

It has been proposed from time to time to cover the rubber coating of the ink application roller by a sleeve of textile or felted or felt-like material which, by storing damping liquid, or water therein, is intended to repel ink, and thus enhance the formation of a film of damping liquid on the printing plate. For this reason, it has been customary to place between the homogenizing or rubbing cylinder with the hard metallic surface and the plate cylinder carrying the plate only the damping liquid application roller, which is always required.

THE INVENTION

It is an object to provide a damper or damping system for a printing plate of a printing machine, typically a rotary offset printing machine, which provides a qualitatively improved damping or application of damping liquid without requiring, necessarily, additional space or auxiliary equipment such as bearings and the like for rollers, and in which non-uniformities due to formation of drops or droplets will be effectively eliminated, so that no such irregularities can be observed on the printed copy.

Briefly, the system includes, as is customary, a spray or slinger device to apply damping liquid, for example in drop or droplet form, on a receiving roller having a hydrophilic, hard surface. The damping liquid is applied to the plate cylinder by an application roller of conventional construction, for example having a soft or rubbery surface. The damping liquid is transferred from the liquid receiving roller to the application roller by at least one transfer roller. In accordance with the invention, the at least one transfer roller has an elastic surface, for example plastic, rubber, or the like.

It has been found, surprisingly, that by changing the surface of the transfer roller from the prior, customary hard or metallic surface to a soft rubber surface, the uniformity of application of damping liquid can be substantially enhanced, since the type of film which will form on the soft or resilient surface of such a transfer roller will be entirely different from that which forms on the previously used hard or chromed surface of such a transfer roller.

The transfer roller need not have a rubber jacket or surface; it may have a rubber layer, and, at the outside, a textile or felt-like coating. Although it might be expected that the problems would increase by interposing yet another roller with a yielding resilient surface, which is hydrophilic, between the actual application roller and the liquid receiving roller, it has been found that the quality of printed copy is substantially enhanced since the film of damping liquid which will be applied to the plate is rendered more uniform. It appears that this additional uniformity of the film is due to the additional kneading action of the intermediate transfer roller with the soft surface which thereby enhances the formation of an emulsion of ink and water. This emulsion, due to this apparent kneading action, will be of extremely fine grain and provides a uniform film of water or other damping liquid. Such a fine grain film which can continuously transfer water could not be obtained by using a transfer cylinder with a hard surface.

After introducing the additional transfer cylinder, with the rubber or textile or other soft surface between the water receiving roller and the application roller, the uniformity of the film is increased and the system is operative in either direction of rotation of the printing roller, that is, also in a system in which the inking of the plate is carried out in advance—with respect to the direction of rotation of the plate cylinder—of application of damping liquid.

DRAWINGS

FIG. 1 is a schematic representation of the cylinders of a rotary offset printing press, in which four printing systems are located, in star form, about a satellite cylinder; and FIG. l*a* is a fragmentary detail view of another embodiment of the damper.

DETAILED DESCRIPTION

Figures 1, 1A:
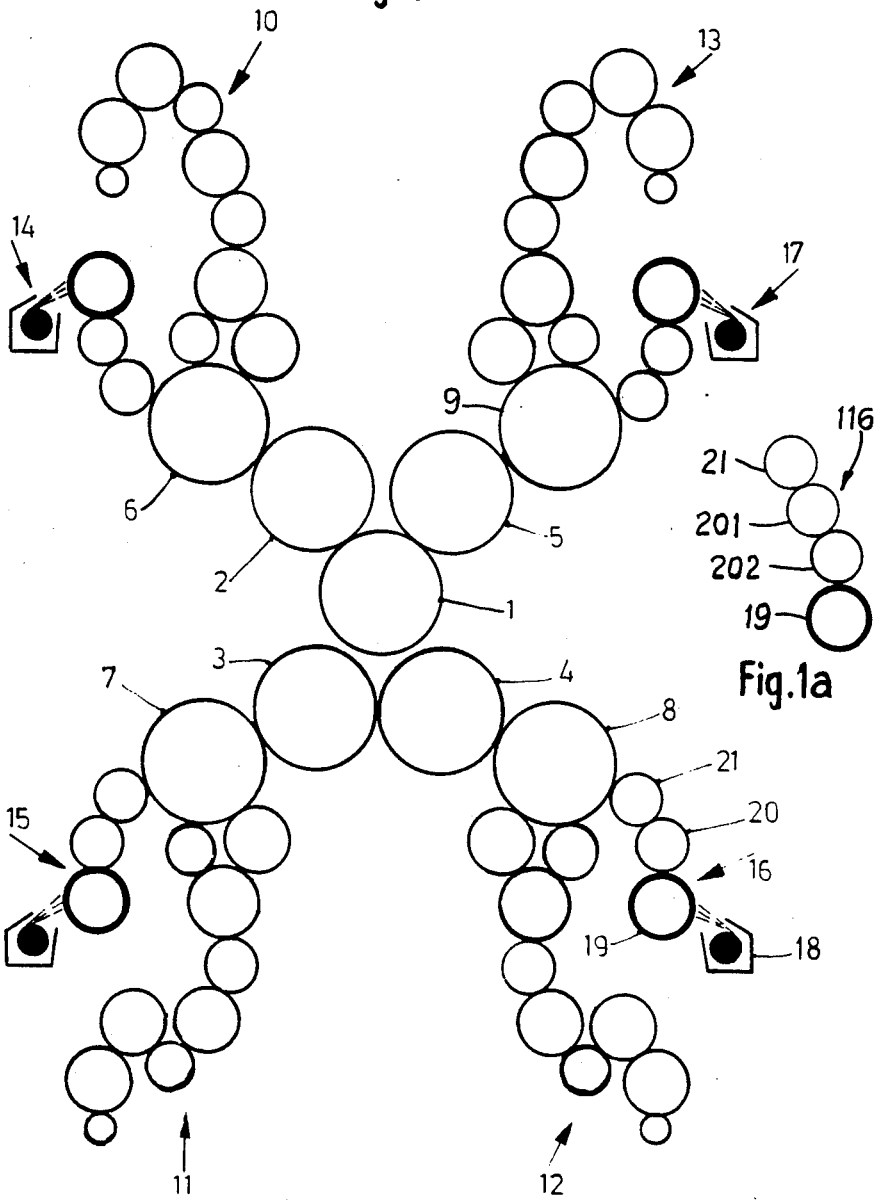

The printing machine is shown only schematically, and, in the example given, is adapted for example of newspaper printing. The present invention is applicable to any type of printing machine requiring damping liquid, of course. The machine shown in FIG. 1 has a central impression cylinder located in the form of a satellite cylinder, about which rubber blanket cylinders 2, 3, 4, 5 are located. In the drawing, blanket cylinders 3, 4 are out of engagement with the printing cylinder 1, for example by being pivoted away from the printing cylinder 1 by eccentrically positionable bearings. The drawing is illustrative and shown in this manner for ease of illustration. Each one of the blanket cylinders 2–5 has an associated plate cylinder 6, 7, 8, 9. Each one of the plate cylinders, in customary manner, has an inker 10, 11, 12, 13, and a damper 14, 15, 16, 17 associated therewith.

The invention will be described with respect to the damper 16, at the right, lower side of FIG. 1. The other dampers can be constructed identically. The damper includes a spray device 18. Rather than using a spray device, slingers, spray nozzles, or liquid application brushes may also be used. The spray device 18, which may also be referred to as a contactless liquid application system, supplies typically water in form of fine drops or droplets to a water receiving roller 19. Roller 19 is a homogenizing cylinder having a hard metallic surface. Preferably, roller 19 has a chrome surface. The droplets are applied to a further or transfer roller 20 which is located between the hard-surface roller 19 and a damping liquid application roller 21 which, in turn, is in surface contact with the plate cylinder 8. The damping liquid application roller 21 has a soft surface. Damping liquid is supplied from the second or intermediate or transfer roller 20 via the roller 21 to the printing plate. Typically, roller 21 will have a rubber surface, for example in form of a rubber sleeve. Rollers 20 and 21 are mounted for rotational movement in the usual manner, that is without axial oscillation.

In accordance with the present invention, the transfer roller 20 has a soft surface, for example a rubber jacket over a support roller structure, or otherwise a rubber coating on a roller. In addition to the rubber coating on the roller, a textile cover or jacket may be placed over the rubber, or directly over a roller structure.

Use of a transfer roller having an elastic surface, interposed between the homogenizing and liquid receiving cylinder 19 and the soft-surface application roller 21 results, apparently, in the formation of a coating of an emulsion of ink and damping liquid of finest grain, or finest and uniform composition which, apparently, is the basis for the unexpected uniform damping of the plate cylinder 8.

More than one such additional transfer roller may be used; FIG. 1*a* illustrates an arrangement in which, between the liquid accepting roller 19 and the application roller 21, two transfer rollers 201, 202 are located, to form a damping a damping liquid transfer system 116. More than two such additional rollers may be used; increasing the number of transfer rollers, one in FIG. 1, two in FIG. 1*a* or more, increases the quality of the damping liquid film being transferred to the transfer roller 21 and hence to the plate cylinder 8.

We claim:

1. In a rotary printing machine having a plate cylinder (8), a damper to apply damping liquid to a printing plate on the plate cylinder (8) comprising a damping liquid receiving roller (19) having a hard damping liquid accepting surface;

a spray device (18) spraying damping liquid on the hard surface of the receiving roller, the damping liquid collecting on the receiving roller in drops or droplets as derived from the spray device;

means for transferring damping liquid from said receiving roller (19) while rendering uniform the damping liquid received from the receiving roller, and collected thereon in form of drops or droplets, and for application to the plate cylinder as a uniform film consisting of at least one damping liquid transfer roller (20; 201, 202) having an elastic surface, and contacting said receiving roller for transferring damping liquid from the receiving roller (19) and a damping liquid application roller (21) having a soft elastic surface in contact with both said plate cylinder and at least one of said liquid transfer rollers (20, 201, 202) for transferring damping fluid from said liquid transfer roller to said printing plate, said damping liquid application roller and said at least one damping liquid transfer roller all being mounted for rotational movement without axial oscillation;

said transferring means serving as a means for preventing the formation of non-uniformities on matter being printed due to the formation of water drops.

2. System according to claim 1, wherein the at least one transfer roller (20; 201, 202) has a rubber surface.

3. System according to claim 1, wherein the damping liquid application roller (21) has a rubber surface.

4. System according to claim 1, wherein both the damping liquid application roller (21) and the at least one transfer roller (20; 201, 202) has a rubber-type surface.

5. System according to claim 1, wherein the damping liquid receiving roller (19) has a chrome surface and is formed as a rubbing cylinder.

6. System according to claim 1, wherein (FIG. 1) the at least one transfer roller comprises a single transfer roller (20).

7. System according to claim 1, wherein (FIG. 1*a*) the at least one transfer roller comprises a plurality of rollers (201, 202), each having an elastic surface.

8. System according to claim 6, wherein said single roller has a rubber-type surface.

9. System according to claim 7, wherein each of said transfer rollers has rubber-type surfaces.

* * * * *